US010291991B2

(12) United States Patent
Shan et al.

(10) Patent No.: US 10,291,991 B2
(45) Date of Patent: May 14, 2019

(54) ELECTRICAL-ACOUSTIC TRANSFORMATION DEVICE AND ELECTRONIC DEVICE

(71) Applicant: Goertek, Inc., Weifang, Shandong (CN)

(72) Inventors: Lianwen Shan, Weifang (CN); Xinfeng Yang, Weifang (CN); Hairong Wang, Weifang (CN); Longhao Cui, Weifang (CN)

(73) Assignee: GOERTEK, INC., Weifang, Shandong (CN)

( * ) Notice: Subject to any disclaimer, the term of this patent is extended or adjusted under 35 U.S.C. 154(b) by 0 days.

(21) Appl. No.: 15/552,555

(22) PCT Filed: Dec. 17, 2015

(86) PCT No.: PCT/CN2015/097756
§ 371 (c)(1),
(2) Date: Aug. 22, 2017

(87) PCT Pub. No.: WO2016/184094
PCT Pub. Date: Nov. 24, 2016

(65) Prior Publication Data

US 2018/0054680 A1 Feb. 22, 2018

(30) Foreign Application Priority Data

May 21, 2015 (CN) ..... 2015 1 0264434

(51) Int. Cl.
*H04R 1/02* (2006.01)
*H04R 1/24* (2006.01)
(Continued)

(52) U.S. Cl.
CPC ..... *H04R 19/02* (2013.01); *H04R 1/24* (2013.01); *H04R 1/403* (2013.01); *H04R 7/06* (2013.01);
(Continued)

(58) Field of Classification Search
CPC ..... H04R 19/02; H04R 19/013; H04R 1/403; H04R 17/005; H04R 7/06; H04R 2499/11
See application file for complete search history.

(56) References Cited

U.S. PATENT DOCUMENTS

| | | | | |
|---|---|---|---|---|
| 8,243,966 | B2 | 8/2012 | Lin et al. | |
| 2007/0023229 | A1 | 2/2007 | Yang | |
| 2013/0202134 | A1* | 8/2013 | Afshar | H04R 1/22 381/151 |

FOREIGN PATENT DOCUMENTS

| | | | |
|---|---|---|---|
| CN | 201509306 | U | 6/2010 |
| CN | 101848405 | A | 9/2010 |

(Continued)

*Primary Examiner* — Sunita Joshi
(74) *Attorney, Agent, or Firm* — Hultquist, PLLC; Steven J. Hultquist

(57) ABSTRACT

Disclosed are an electrical-acoustic transformation device and an electronic device, including a moving coil electrical-acoustic transformation unit and a piezoelectric buzzer. The electrical-acoustic transformation device in the present invention has a moving coil sound generating structure and a piezoelectric sound generating structure. The piezoelectric plate compensates the high-frequency response of a vibrating system, realizing an electrical-acoustic transformation device with good performance and super wideband.

9 Claims, 2 Drawing Sheets

(51) Int. Cl.

| | |
|---|---|
| ***H04R 17/00*** | (2006.01) |
| ***H04R 1/22*** | (2006.01) |
| ***H04R 19/01*** | (2006.01) |
| ***H04R 19/02*** | (2006.01) |
| ***H04R 1/40*** | (2006.01) |
| ***H04R 7/06*** | (2006.01) |

(52) U.S. Cl.
CPC ..... *H04R 17/005* (2013.01); *H04R 19/013* (2013.01); *H04R 1/025* (2013.01); *H04R 1/225* (2013.01); *H04R 17/00* (2013.01); *H04R 2499/11* (2013.01)

(56) References Cited

FOREIGN PATENT DOCUMENTS

| | | | | |
|---|---|---|---|---|
| CN | 202269012 | U | | 6/2012 |
| CN | 103533491 | A | | 1/2014 |
| CN | 204231593 | U | * | 3/2015 |
| CN | 204598294 | U | | 8/2015 |
| CN | 104883646 | A | | 9/2015 |

* cited by examiner

ELECTRICAL-ACOUSTIC TRANSFORMATION DEVICE AND ELECTRONIC DEVICE

CROSS-REFERENCE TO RELATED APPLICATIONS

This application is a U.S. national phase under the provisions of 35 U.S.C. § 371 of International Patent Application No. PCT/CN2015/097756 filed Dec. 17, 2015, which in turn claims priority of Chinese Patent Application No. 201510264434.7 filed May 21, 2015. The disclosures of such international patent application and Chinese priority patent application are hereby incorporated herein by reference in their respective entireties, for all purposes.

TECHNICAL FIELD

The present invention relates to an electrical-acoustic transformation device and an electronic device.

BACKGROUND

Ordinary moving coil receivers and speakers are referred to as moving coil electrical-acoustic transformation device. No matter if it is applied to a mobile phone or an earphone, rapid drop will occur in the high frequency response curve of the receiver at 6 k-9 kHz and rapid drop will also occur in the high frequency response curve of the speaker after 10 KHz, which is the so-called high frequency cutoff frequency. Due to the limitations of the material and process of the moving coil electrical-acoustic transformation device, it is hard to increase the high frequency cutoff frequency.

With the application of 4G communications, electrical-acoustic transformation devices with super wideband are required. The high frequency cutoff frequency is required to be up to 16 kHz and higher. Thus, the existing moving coil electrical-acoustic transformation device cannot meet these requirements.

SUMMARY

An object of the present invention is to provide a new technical solution of an electrical-acoustic transformation device with super wideband.

According to a first aspect of the present invention, an electrical-acoustic transformation device is provided, including a moving coil electrical-acoustic transformation unit and a piezoelectric buzzer.

Preferably, the moving coil electrical-acoustic transformation unit and the piezoelectric buzzer are overlapped or arranged side by side.

Preferably, the piezoelectric buzzer is circular, or rectangular or annular.

Optionally, the moving coil electrical-acoustic transformation unit is a moving coil receiver or a moving coil speaker.

Preferably, the piezoelectric buzzer is annular and sleeves the periphery of the moving coil electrical-acoustic transformation unit.

According to a second aspect of the present invention, an electronic device is provided, comprising an electrical-acoustic transformation device mentioned above and a housing for accommodating the electrical-acoustic transformation device, wherein the housing is provided with an acoustic hole opposite to the electrical-acoustic transformation device.

Preferably, the moving coil electrical-acoustic transformation unit and the piezoelectric buzzer share one acoustic hole.

Preferably, the moving coil electrical-acoustic transformation unit and the piezoelectric buzzer are overlapped; the moving coil electrical-acoustic transformation unit, the piezoelectric buzzer and the housing are arranged successively from inside out; or the piezoelectric buzzer, the moving coil electrical-acoustic transformation unit and the housing are arranged successively from inside out.

Preferably, the moving coil electrical-acoustic transformation unit and the piezoelectric buzzer are arranged side by side at the inner side of the housing.

Preferably, the piezoelectric buzzer is circular, or rectangular or annular.

Preferably, the piezoelectric buzzer is annular and sleeves the periphery of the moving coil electrical-acoustic transformation unit.

The inventors of the present invention have found that there is no electrical-acoustic transformation device with super wideband combined with a moving coil sound generating structure in the prior art. Thus, the technical task to be realized by the present invention or the technical problem to be solved is not contemplated or predicted by those skilled in the art, so the present invention is a new technical solution.

The electrical-acoustic transformation device and the electronic device in the present invention have a moving coil sound generating structure and a piezoelectric sound generating structure. The piezoelectric plate compensates the high-frequency response of a vibrating system, realizing an electrical-acoustic transformation device with good performance and super wideband.

The other features and advantages of the present invention will become clear according to the detailed description of exemplary embodiments of the present invention with reference to the accompanying drawings.

BRIEF DESCRIPTION OF THE DRAWINGS

The figures incorporated in the description and forming a part of the description illustrate the embodiments of the present invention and are used to explain the principle of the present invention along therewith.

REFERENCE SIGNS

Figure 1:
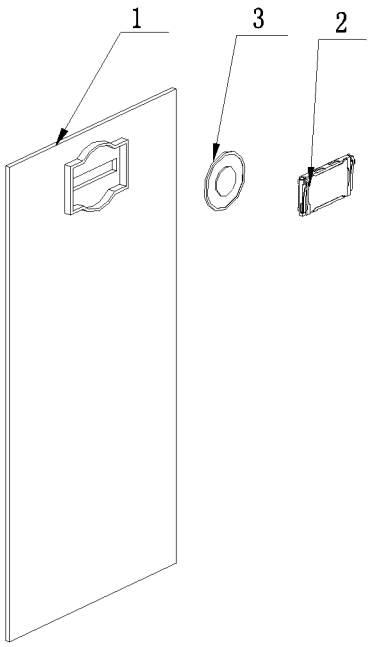
FIG. 1 is an exploded view of an electronic device according to a first embodiment of the present invention.

1 housing, 2 moving coil electrical-acoustic transformation unit, 3 piezoelectric buzzer, 100 acoustic hole.

DETAILED DESCRIPTION

Various exemplary embodiments of the present invention will be described in detail with reference to the accompanying drawings. It should be noted that unless stated specifically otherwise, the relative arrangement of the components and steps illustrated in these embodiments, the numeral expressions and the values do not limit the scope of the present invention.

The description of at least one exemplary embodiment of the present invention is actually merely illustrative rather than limiting the present invention and the application or use thereof.

Technologies, methods and devices known to those skilled in the art may not be described in detail, but when appropriate, the technologies, methods and devices shall be regarded as a part of the description.

Any particular value in all examples illustrated and described here shall be construed as merely illustrative rather than limiting. Thus, other examples of the exemplary embodiments may have different values.

It should be noted that similar signs and letters represent similar items in the following figures, and thus, once a certain item is defined in a figure, there is no need to further describe the same in the following figures.

An embodiment of the present invention provides an electrical-acoustic transformation device, including a moving coil electrical-acoustic transformation unit and a piezoelectric buzzer. The moving coil electrical-acoustic transformation unit and the piezoelectric buzzer may be overlapped or arranged side by side. The piezoelectric buzzer may be circular, or rectangular or annular. The moving coil electrical-acoustic transformation unit may be a moving coil receiver or a moving coil speaker.

The resonance frequency of the piezoelectric buzzer may be 1 k-40 kHz. The sound volume is very high at and after the resonance frequency. At the same time, the piezoelectric buzzer also has the following advantages. 1. Since there is no movable contact portion, the service life is long, the reliability is high, the continued usage time may be up to 10,000 hours, and it is a half-permanent device. 2. No arcing or radio frequency noise will be generated, so no interference will be generated to other lines. 3. No large vibration will occur due to loosing. 4. The tone is pure and not easy to be covered by noise. 5. It is excited through voltages, and less current will be consumed, which is usually below 20 mA and will not exceed 100 mA. 6. It is miniaturized and has a large sound volume, the sound volume may be up to 70 dB/20 cm, and the element thickness is merely below 1 mm. 7. The operation temperature range is wide. 8. It is easy to install. As there is no electromagnetic coil or moving coil, there is no need to worry about insulation degradation and there is no possibility of current leakage.

A piezoelectric buzzer with a suitable resonance frequency is selected to make the moving coil electrical-acoustic transformation unit and the piezoelectric electrical-acoustic transformation unit work simultaneously, which can compensate the high frequency response of the moving coil electrical-acoustic transformation unit. The superimposed frequency response after compensation may behave well above 20 kHz or even 40 kHz. Since the voltages provided to the moving coil electrical-acoustic transformation unit and the piezoelectric buzzer are different, the audio signals thereof are input separately.

Figure 2:
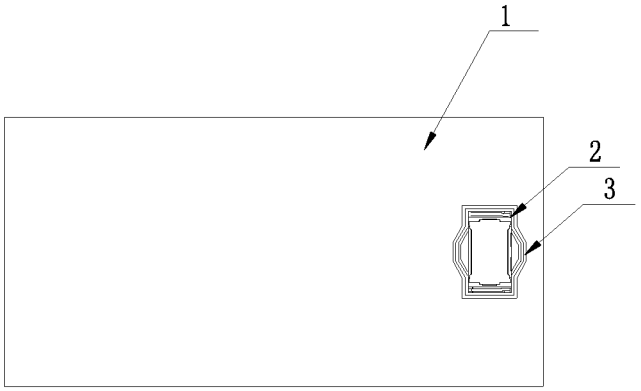
FIG. 2 is an internal structure view of an electronic device according to a first embodiment of the present invention.
Figure 3:
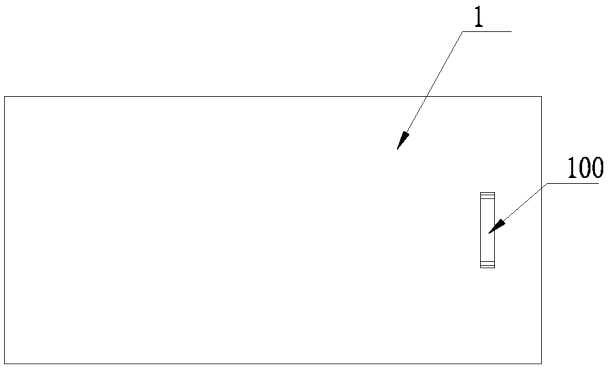
FIG. 3 is a view of an outer surface of an electronic device according to a first embodiment of the present invention.

FIGS. 1 to 3 respectively show a first embodiment of an electronic device including a housing 1 and an electrical-acoustic transformation unit. FIGS. 1 to 3 merely schematically show a part of the housing 1 respectively. An acoustic hole 100 is provided on the housing 1. The electrical-acoustic transformation unit is provided inside the housing 1 and opposite the acoustic hole 100. The moving coil electrical-acoustic transformation unit 2 and the piezoelectric buzzer 3 are overlapped together to share the acoustic hole 100. The moving coil electrical-acoustic transformation unit 2, the piezoelectric buzzer 3 and the housing 1 are provided successively from inside out. Of course, in other embodiments, the piezoelectric buzzer 3, the moving coil electrical-acoustic transformation unit 2 and the housing 1 may be provided successively from inside out.

Figure 4:
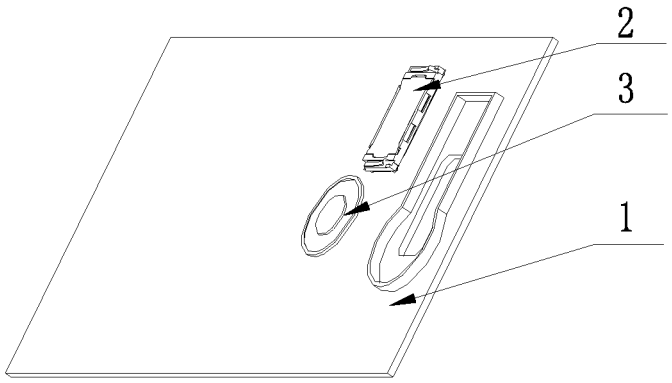
FIG. 4 is an exploded view of an electronic device according to a second embodiment of the present invention.
Figure 5:
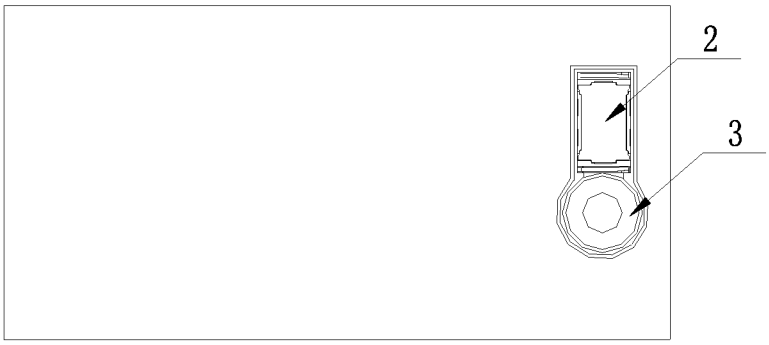
FIG. 5 is an internal structure view of an electronic device according to a second embodiment of the present invention.
Figure 6:
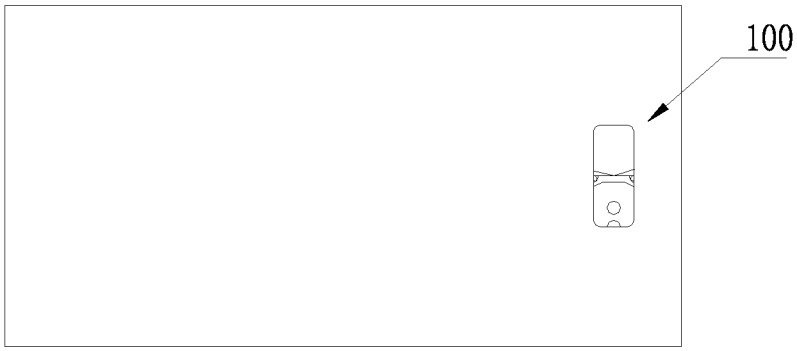
FIG. 6 is a view of an outer surface of an electronic device according to a second embodiment of the present invention.

FIGS. 4 to 6 respectively show a second embodiment of an electronic device including a housing 1 and an electrical-acoustic transformation unit. FIGS. 1 to 3 merely schematically show a part of the housing 1 respectively. An acoustic hole 100 is provided on the housing 1. The electrical-acoustic transformation unit is provided inside the housing 1 and opposite the acoustic hole 100. The moving coil electrical-acoustic transformation unit 2 and the piezoelectric buzzer 3 are provided on the inner side of the housing 1 side by side to share the acoustic hole 100.

The piezoelectric buzzer in the above embodiments may be circular. The piezoelectric buzzer may also be annular so as to sleeve the periphery of the moving coil electrical-acoustic transformation unit, which is advantageous to save the assembly space. The piezoelectric buzzer may also be rectangular, which is convenient to assemble with a rectangular moving coil electrical-acoustic transformation unit.

The electrical-acoustic transformation device and the electronic device in an embodiment of the present invention have a moving coil sound generating structure and a piezoelectric sound generating structure. The piezoelectric plate compensates the high-frequency response of a vibrating system, realizing an electrical-acoustic transformation device with good performance and super wideband.

Although some specific embodiments of the present invention have been described in detail by way of example, it should be understood by those skilled in the art that the above examples are merely for the sake of description rather than limiting the scope of the present invention. It should be understood by those skilled that the above embodiments may be modified without departing from the scope and spirit of the present invention. The scope of the present invention is limited by the appended claims.

What is claimed is:

1. An electrical-acoustic transformation device, wherein the device comprises a moving coil electrical-acoustic transformation unit and a piezoelectric buzzer, voltages of the moving coil electrical-acoustic transformation unit and the piezoelectric buzzer are different, and audio signals of the moving coil electrical-acoustic transformation unit and the piezoelectric buzzer are input separately;

wherein the piezoelectric buzzer is annular and sleeves the periphery of the moving coil electrical-acoustic transformation unit.

2. The electrical-acoustic transformation device according to claim 1, wherein the moving coil electrical-acoustic transformation unit and the piezoelectric buzzer are overlapped or arranged side by side.

3. The electrical-acoustic transformation device according to claim 1, wherein the piezoelectric buzzer is circular, or rectangular or annular.

4. The electrical-acoustic transformation device according to claim 1, wherein the moving coil electrical-acoustic transformation unit is a moving coil receiver or a moving coil speaker.

5. An electronic device, comprising:

an electrical-acoustic transformation device, the electrical-acoustic transformation device comprising a moving coil electrical-acoustic transformation unit and a piezoelectric buzzer, voltages of the moving coil electrical-acoustic transformation unit and the piezoelectric buzzer are different, and audio signals of the moving coil electrical-acoustic transformation unit and the piezoelectric buzzer are input separately; and a housing for accommodating the electrical-acoustic transformation device, wherein the housing is provided with an acoustic hole opposite to the electrical-acoustic transformation device.

6. The electronic device according to claim 5, wherein the moving coil electrical-acoustic transformation unit and the piezoelectric buzzer share one acoustic hole.

7. The electronic device according to claim 5, wherein the moving coil electrical-acoustic transformation unit and the piezoelectric buzzer are overlapped; the moving coil electrical-acoustic transformation unit, the piezoelectric buzzer and the housing are arranged successively from inside out; or the piezoelectric buzzer, the moving coil electrical-acoustic transformation unit and the housing are arranged successively from inside out.

8. The electronic device according to claim 5, wherein the moving coil electrical-acoustic transformation unit and the piezoelectric buzzer are arranged side by side at the inner side of the housing.

9. The electronic device according to claim 5, wherein the piezoelectric buzzer is circular, or rectangular or annular.

* * * * *